US009254978B2

(12) United States Patent
Furukawa

(10) Patent No.: US 9,254,978 B2
(45) Date of Patent: Feb. 9, 2016

(54) SEASONING APPARATUS AND METHOD

(75) Inventor: Koji Furukawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 492 days.

(21) Appl. No.: 13/534,895

(22) Filed: Jun. 27, 2012

(65) Prior Publication Data

US 2013/0004652 A1 Jan. 3, 2013

(30) Foreign Application Priority Data

Jun. 28, 2011 (JP) ..... 2011-143240

(51) Int. Cl.

*B05D 3/06* (2006.01)
*G21K 5/08* (2006.01)
*B65H 31/00* (2006.01)

(52) U.S. Cl.

CPC ..... *B65H 31/00* (2013.01); *B65H 2301/514* (2013.01); *B65H 2406/10* (2013.01); *B65H 2515/212* (2013.01); *B65H 2515/60* (2013.01); *B65H 2515/83* (2013.01); *B65H 2557/514* (2013.01); *B65H 2701/18282* (2013.01); *B65H 2801/24* (2013.01)

(58) Field of Classification Search

None

See application file for complete search history.

(56) References Cited

U.S. PATENT DOCUMENTS 2,281,184 A * 4/1942 Dykstra et al. ..... 34/233
3,737,051 A * 6/1973 Horino ..... 414/788
3,769,517 A * 10/1973 Coleman ..... 250/455.11
5,035,066 A * 7/1991 Wimberger ..... 34/641
2003/0132223 A1* 7/2003 Ueno ..... 219/520
2003/0177927 A1* 9/2003 Dziedzic et al. ..... 101/424.1
2007/0022625 A1* 2/2007 DeRegge et al. ..... 34/275
2007/0267803 A1* 11/2007 Tateishi et al. ..... 271/98
2008/0247774 A1* 10/2008 Koga ..... 399/97

FOREIGN PATENT DOCUMENTS

JP 10-297813 A 11/1998
JP 2007-245653 A 9/2007
JP 2011020807 A * 2/2011

OTHER PUBLICATIONS

English translation of JP2011020807.*

* cited by examiner

*Primary Examiner* — Charles Capozzi

(74) *Attorney, Agent, or Firm* — Birch, Stewart, Kolasch & Birch, LLP

(57) ABSTRACT

A seasoning apparatus includes: a table on which a stack of paper sheets is loaded, each of the paper sheets having at least one face on which active light curable aqueous ink has been deposited; an air blowing device which blows air in an air blowing direction to a side of the stack loaded on the table; an active light emission device which emits the active light in an active light emitting direction to a side of the stack loaded on the table; and a control device which causes the air blowing device to blow the air to the stack to create gaps between faces of the paper sheets, and causes the active light emission device to emit the active light to the stack to cause the active light to enter the gaps.

12 Claims, 6 Drawing Sheets

SEASONING APPARATUS AND METHOD

BACKGROUND OF THE INVENTION

1. Field of the Invention

The present invention relates to a seasoning apparatus and a seasoning method, and more particularly to technology for seasoning a stack of sheets of paper on which printing has been performed using ultraviolet-curable water-based ink.

2. Description of the Related Art

When ink is deposited on a sheet of paper in a printing apparatus, expansion and contraction of the paper sheet occurs immediately after the ink deposition due to differences in the amount of water within the paper sheet resulting from light and dark tones (i.e., difference in deposited volumes) of the ink in the image region in the paper sheet. This problem is especially pronounced in a system that prints onto general printing paper using water-based ink. Moreover, when carrying out double-side printing, normally, after completing printing on one side (a front face) of a paper sheet, printing is subsequently carried out on the reverse side (a rear face) of the paper sheet; however, since there is significant expansion of the paper sheet immediately after the printing on the front face, then a problem arises in that deviation occurs in the sizes and positions of the images printed respectively on the front face and the rear face (i.e., there is mismatch between the front and rear positional registration).

Furthermore, in the case of single-side printing also, and not only double-side printing, there is a problem that the occurrence of cackling (undulation) of the printed paper sheet as a result of the above-described deformation of the paper sheet causes deterioration of printing quality and also causes adverse effects on subsequent processing steps, such as a binding process, which are carried out after the printing step.

In order to prevent these problems, it is necessary to season the paper sheet immediately after printing so as to adapt the paper sheet to the ambient temperature and humidity.

Japanese Patent Application Publication No. 10-297813 discloses technology in which the periphery of a stack of paper sheets is enclosed by side plates and air is blown through at least one air blowing port arranged in the side plate, whereby dispersion of the air blown through the air blowing port to the exterior of the paper stack is prevented, and the air can be caused to flow efficiently in amongst the paper sheets. Japanese Patent Application Publication No. 10-297813 further discloses technology for sucking air between the paper sheets when the air blowing has ended, so as to press down the disordered paper sheets to be stacked in order.

In addition, with conventional thermoplastic ink, image strength is poor and scratches occur during subsequent processing, and the like, and therefore ink that is curable with active light (e.g., ultraviolet (UV)) is desirable. In order to reduce organic solvent in the ink due to environmental considerations, UV-curable water-based ink containing water as a solvent has been developed; however, this entail a problem in that curing of the UV-curable water-based ink does not progress efficiently, due to the presence of water in the ink.

Japanese Patent Application Publication No. 2007-245653 discloses an image forming method in which an image formed from UV-curable water-based ink on a recording medium is irradiated with UV light by a UV light irradiation device, and the method includes a step of blowing a warm air flow onto the image by a warm air flow blowing device, and a subsequent step of curing the ink forming the image by irradiation of UV light of maximum intensity by the UV light irradiation device. In this method, however, if the printing speed is fast, a problem arises in that there is insufficient time to cure the ink forming the image and, although the surface of the printed item is cured, the interior portion thereof cannot be cured adequately.

SUMMARY OF THE INVENTION

The present invention has been contrived in view of these circumstances, an object thereof being to provide a seasoning apparatus and a seasoning method capable of rapidly adapting sheets of paper on which printing has been performed using active light curable aqueous ink to an ambient humidity, as well as promoting curing of the ink.

In order to attain the aforementioned object, the present invention is directed to a seasoning apparatus, comprising: a table on which a stack of paper sheets is loaded, each of the paper sheets having at least one face on which active light curable aqueous ink has been deposited; an air blowing device which blows air in an air blowing direction to a side of the stack loaded on the table; an active light emission device which emits the active light in an active light emitting direction to a side of the stack loaded on the table; and a control device which causes the air blowing device to blow the air to the stack to create gaps between faces of the paper sheets, and causes the active light emission device to emit the active light to the stack to cause the active light to enter the gaps.

According to this aspect of the present invention, by causing the air blowing device to blow the air to the stack of paper sheets so as to create gaps between the faces of the paper sheets, and causing the active light emission device to emit the active light to the stack of paper sheets in such a manner that the active light enters the gaps, it is possible to season the paper sheets as well as to promote curing of the active light curable aqueous ink that has been deposited on the faces of the paper sheets.

Preferably, the air blowing direction and the active light emitting direction are substantially parallel to each other. It is thereby possible to arrange the active light emission device without increasing the size of the seasoning apparatus.

It is also preferable that the air blowing direction and the active light emitting direction are substantially perpendicular to each other. It is thereby possible that the air blowing device and the active light emission device perform the air blow and the active light emission without interfering with each other.

Preferably, the active light emission device includes active light emission elements which emit the active light to at least two sides of the stack loaded on the table. It is thereby possible to uniformly irradiate the whole face of each paper sheet with the active light.

Preferably, the seasoning apparatus further comprises: a right-hand side plate and a left-hand side plate which are arranged to oppose to each other at a right-hand side and a left-hand side of the stack loaded on the table, at least one of the right-hand side plate and the left-hand side plate being advanceable and retractable relatively to each other, wherein the active light emission elements are arranged respectively on the right-hand side plate and the left-hand side plate. It is thereby possible to arrange the active light emission elements without increasing the size of the seasoning apparatus.

It is also preferable that the seasoning apparatus further comprises: a right-hand side plate and a left-hand side plate which are made from a material transmitting the active light and are arranged to oppose to each other at a right-hand side and a left-hand side of the stack loaded on the table, at least one of the right-hand side plate and the left-hand side plate being advanceable and retractable relatively to each other, wherein the active light emission elements are arranged on sides of the right-hand side plate and the left-hand side plate to face the stack loaded on the table across the right-hand side plate and the left-hand side plate, respectively. It is thereby possible to arrange the active light emission elements without increasing the size of the seasoning apparatus.

Preferably, the seasoning apparatus further comprises a movement device which moves the active light emission device up and down. It is thereby possible to uniformly irradiate the paper sheets with the active light.

Preferably, the seasoning apparatus further comprises: a housing which shuts off the stack loaded on the table from external environment; and an inert gas supply device which supplies inert gas inside the housing. It is thereby possible to remove oxygen, which impedes the curing of the active light curable ink.

Preferably, the seasoning apparatus further comprises a temperature and humidity adjustment device which adjusts temperature and humidity inside the housing. It is thereby possible to perform the seasoning appropriately.

Preferably, the seasoning apparatus further comprises: a humidity measurement device which measures humidity outside the housing, wherein the temperature and humidity adjustment device adjusts the temperature inside the housing to be lower than 100° C. and not lower than 50° C., and adjusts the humidity inside the housing correspondingly to the humidity outside the housing. It is thereby possible to accelerate the curing of the active light curable ink.

It is also preferable that the seasoning apparatus further comprises: a temperature and humidity measurement device which measures temperature and humidity outside the housing, wherein the temperature and humidity adjustment device adjusts the temperature inside the housing to be lower than 100° C. and not lower than 50° C., and then, after a prescribed period of time has elapsed, adjusts the temperature and the humidity inside the housing correspondingly to the temperature and the humidity outside the housing. It is thereby possible to perform the seasoning appropriately.

Preferably, the inert gas is one of nitrogen and carbon dioxide. It is thereby possible to have the seasoning apparatus be safe and inexpensive.

Preferably, the active light emission device emits ultraviolet light by which the active light curable aqueous ink is cured. It is thereby possible to use the seasoning apparatus for curing the UV-curable aqueous ink having been deposited on the printed paper sheets while seasoning the printed paper sheets.

In order to attain the aforementioned object, the present invention is also directed to a seasoning method, comprising: an air blowing step of blowing air in an air blowing direction to a side of a stack of paper sheets to create gaps between faces of the paper sheets, each of the paper sheets having at least one face on which active light curable aqueous ink has been deposited; and an active light emitting step of emitting the active light in an active light emitting direction to a side of the stack to cause the active light to enter the gaps.

Preferably, the active light emitting direction is changed while the active light emitting step.

Preferably, the seasoning method further comprises an inert gas supplying step of supplying inert gas to an environment of the stack.

Preferably, the seasoning method further comprises: a humidity measuring step of measuring humidity outside the environment; and a temperature and humidity adjusting step of adjusting temperature inside the environment to be lower than 100° C. and not lower than 50° C., and adjusts humidity inside the environment correspondingly to the humidity outside the environment.

It is also preferable that the seasoning method further comprising: a temperature and humidity measuring step of measuring temperature and humidity outside the environment; and a temperature and humidity adjusting step of adjusting temperature inside the environment to be lower than 100° C. and not lower than 50° C., and then, after a prescribed period of time has elapsed, adjusting the temperature and humidity inside the environment correspondingly to the temperature and the humidity outside the environment.

Preferably, the inert gas is one of nitrogen and carbon dioxide.

Preferably, in the active light emitting step, the active light is ultraviolet light by which the active light curable aqueous ink is cured.

According to the present invention, the paper sheets on which printing has been performed using active light curable aqueous ink can be rapidly adapted to the ambient humidity, and curing of the active light curable aqueous ink can be promoted.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

A seasoning apparatus according to an embodiment of the present invention can rapidly season a stack of sheets of paper on which printing has been carried out by an inkjet printer using water-based ink that is curable with active light (e.g., ultraviolet (UV)) (hereinafter referred to as the "UV-curable aqueous ink"), uniformly between the paper sheets, where "to season" means to adapt the paper sheets to the ambient humidity. At the same time as seasoning the paper sheets, the seasoning apparatus can also promote curing of the UV-curable aqueous ink.

First Embodiment

Figure 1:
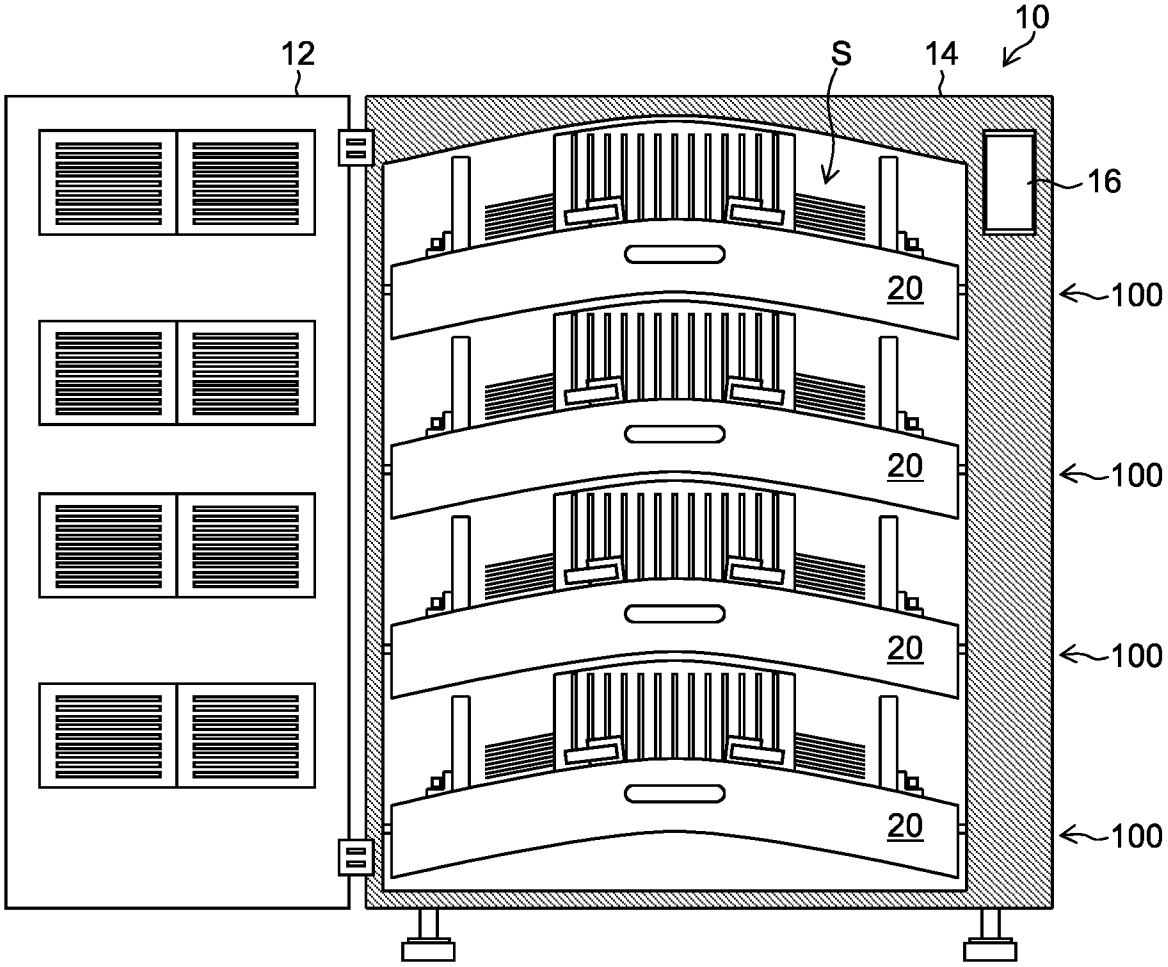
FIG. 1 is a front view diagram of a seasoning apparatus in an embodiment of the present invention.
Figure 2:
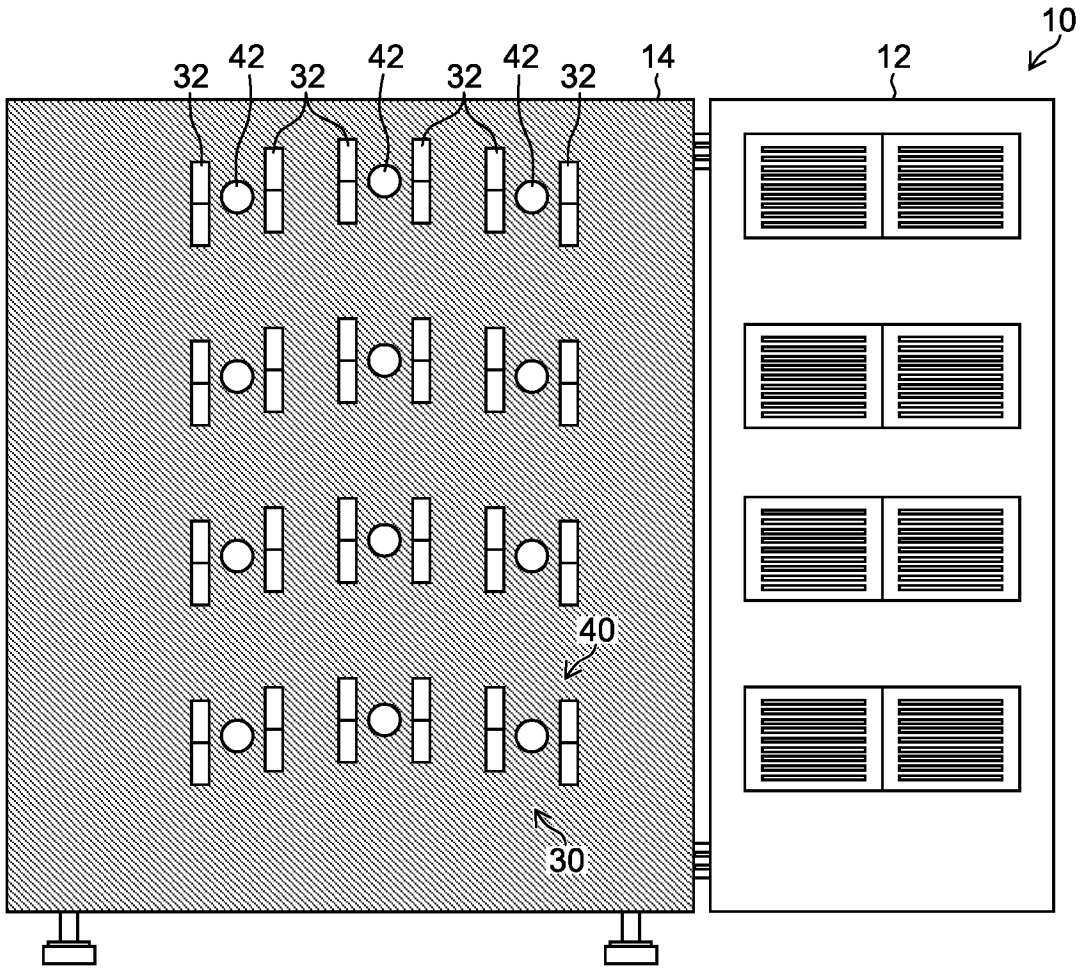
FIG. 2 is a rear view diagram of the seasoning apparatus.

FIG. 1 is a front view diagram of a seasoning apparatus 10 according to the first embodiment of the present invention, and FIG. 2 is a rear view diagram of the seasoning apparatus 10, both of which show the seasoning apparatus 10 with a front cover 12 in an open state.

The seasoning apparatus 10 according to the present embodiment includes a box-shaped casing 14 having the front cover 12 arranged on a front side of the casing 14. A touch panel 16 for an operator to control the seasoning apparatus 10 is arranged on the front side of the seasoning apparatus 10.

The seasoning apparatus 10 is provided with four seasoning units 100, which are stacked inside the casing 14. Each of the seasoning units 100 includes: a table 20, on which a stack of sheets of paper (hereinafter referred to as the "paper stack")

S is loaded; an air blowing unit 30, which blows an ambient air flow (a flow of the air from the ambient atmosphere of the seasoning unit 100) toward the paper stack S; and an ultraviolet (UV) light emission unit 40, which irradiates the paper stack S with UV light.

The tables 20 are arranged so as to be able to load the paper stacks S thereon, by pulling the tables 20 out from the casing 14. The air blowing units 30 and the UV light emission units 40 are arranged at a rear side of the casing 14 of the seasoning apparatus 10.

With respect to each of the seasoning units 100, a plurality of fans 32 constituting the air blowing unit 30 and a plurality of UV light sources 42 constituting the UV light emission unit 40 are arranged on the rear side of the casing 14 at prescribed intervals as shown in FIG. 2.

Figure 3:
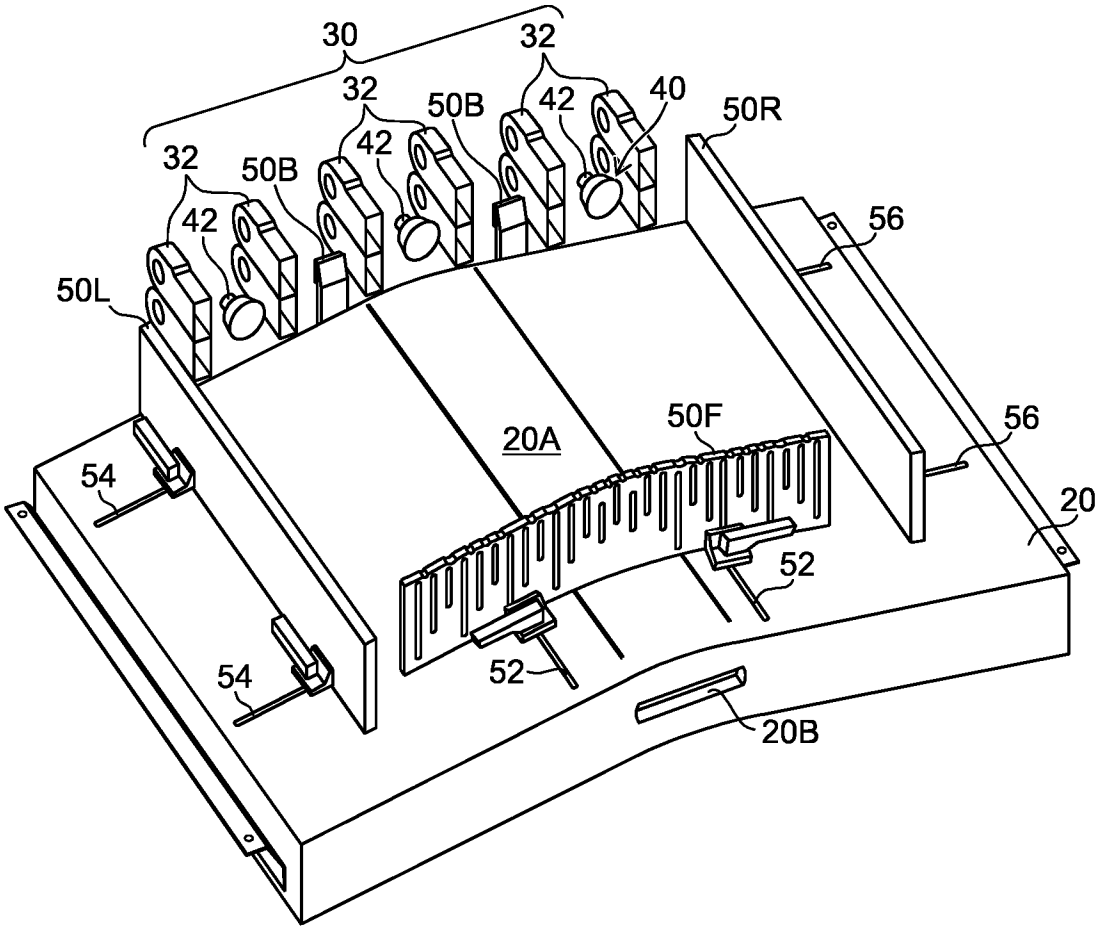
FIG. 3 is a perspective diagram of the seasoning unit.

FIG. 3 is a perspective diagram showing a schematic view of each of the seasoning units 100, in which the casing 14 is omitted from the drawing.

The table 20 is formed in a rectangular shape, and the upper surface thereof serves as a loading surface 20A. The loading surface 20A has a central portion of a ridge shape, and left and right sides, each of which is curved in an arch shape. The paper stack S is loaded onto the loading surface 20A of the table 20. A gripper section 20B is formed on the front face of the table 20. It is also possible that the loading surface 20A is formed to be flat and horizontal.

The table 20 is provided with a front side plate 50F, a left-hand side plate 50L and a right-hand side plate 50R. The front side plate 50F is arranged so as to face to an inner wall of the rear side section of the casing 14 in a state where the table 20 has been accommodated in the casing 14. The left-hand side plate 50L and the right-hand side plate 50R are arranged to oppose to each other and to be perpendicular to the front side plate 50F. More specifically, in the state where the table 20 is accommodated in the casing 14, a rectangular parallelepiped space enclosed by the inner wall of the rear side section of the casing 14 and the side plates 50F, 50L and 50R is defined. The paper stack S which is to be seasoned is loaded in this space.

The front side plate 50F is formed as a rectangular plate having a prescribed width, and a prescribed height that is substantially equal to a distance from the loading surface 20A of the table 20 to a ceiling section of the casing 14 or to the bottom face of another table 20 in the next seasoning unit 100 positioned thereabove. The front side plate 50F is arranged slidably in the front-rear direction of the table 20 (i.e., configured to be advanceable and retractable with respect to the rear side section of the casing 14), by means of a pair of front side plate guides 52.

The front side plate 50F is formed with a plurality of slit-shaped ventilation apertures, through which the air flow blown from the air blowing unit 30 can escape. The ventilation apertures are formed as the slits along the vertical direction in the present embodiment; however, it is also possible that ventilation apertures are formed as openings of other shapes, such as circles, ovals, rectangles, and so on.

The left-hand side plate 50L is formed as a rectangular plate having a height substantially the same as the front side plate 50F, and is arranged slidably in the lateral direction of the table 20 by means of a pair of left-hand side plate guides 54. Similarly, the right-hand side plate 50R is formed as a rectangular plate having a height substantially the same as the front side plate 50F, and is arranged slidably in the lateral direction of the table 20 by means of a pair of right-hand side plate guides 56.

Thus, the side plates 50F, 50L and 50R are arranged slidably, and the space for loading the paper stack S can be adjusted in accordance with the size of the paper sheets to be seasoned.

The table 20 is further provided with a pair of paper pressing plates 50B, which can support a rear end portion of the paper stack S loaded on the table 20 when the table 20 has been pulled out from the casing 14. The paper pressing plates 50B are arranged with a prescribed interval at a rear end portion of the table 20. Each of the paper pressing plates 50B is formed in a rectangular thin plate shape, and is arranged in parallel with the front side plate 50F.

The air blowing unit 30 is constituted of the fans 32. Air blowing apertures corresponding to the shape of the outflow ports of the fans 32 are formed at uniform intervals apart (corresponding to the arrangement intervals between the fans 32) in the rear side section of the casing 14. The fans 32 are stacked in two rows, an upper and lower row, and are installed on the rear side section of the casing 14 with the outflow ports thereof accommodated in the air blowing apertures.

When the fans 32 thus installed are driven, the ambient air is blown out horizontally from the air blowing apertures of the casing 14. The ambient air blown out from the air blowing apertures passes through the interior of the casing 14, and exits the casing 14 through the opening on the front side of the casing 14.

The UV light emission unit 40 is constituted of the UV light sources 42. For the UV light source 42, it is possible to use a mercury lamp, a metal halide lamp, an ultraviolet light-emitting diode (UV-LED), an ultraviolet laser diode (UV-LD), or the like. As described hereinafter, provided that the light source generates ultraviolet light, it is possible to use the light source that emits ultraviolet light of relatively low intensity.

The UV light sources 42 have circular emission ports through which UV light is emitted. It is also possible that the emission ports of the UV light sources 42 are line-shaped.

UV light emission apertures corresponding to the shape of the emission ports of the UV light sources 42 are formed at uniform intervals apart (corresponding to the arrangement intervals between the ultraviolet light sources 42) in the rear side section of the casing 14. The UV light sources 42 are installed on the rear side section of the casing 14 with the emission ports thereof accommodated in the UV light emission apertures.

By arranging the UV light sources 42 between the fans 32 in this way, it is possible to avoid increasing the size of the seasoning apparatus 10.

When the UV light sources 42 thus installed are driven, UV light is horizontally emitted into the casing 14 through the UV light emission apertures in the casing 14. Thus, the air blowing direction of the fans 32 and the UV light emitting direction of the UV light sources 42 are parallel to each other.

Figure 4:
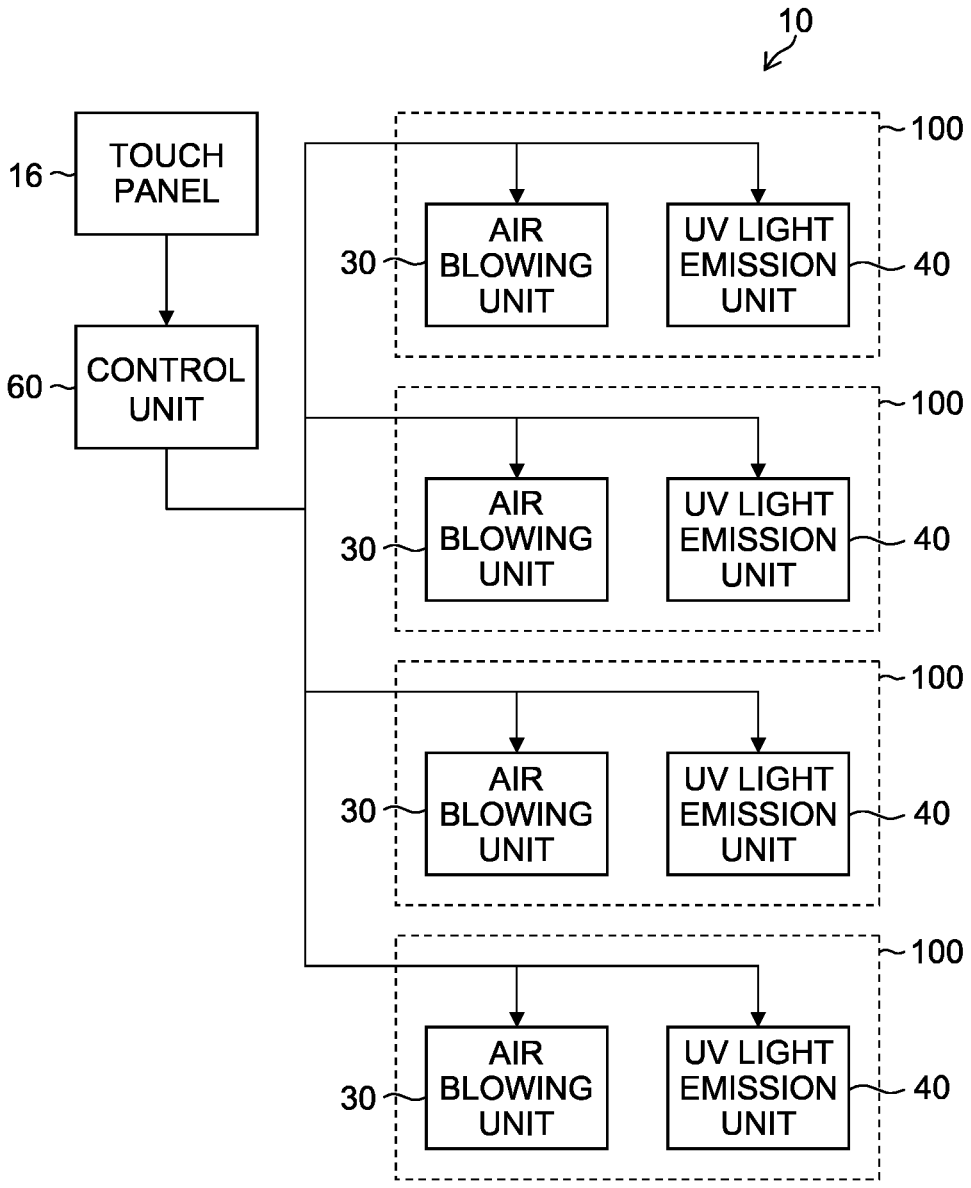
FIG. 4 is a block diagram showing an electrical composition of the seasoning apparatus.

FIG. 4 is a block diagram showing the electrical composition of the seasoning apparatus 10 according to the present embodiment. The seasoning apparatus 10 includes a control unit 60, in addition to the touch panel 16, the air blowing units 30 and the UV light emission units 40 described above.

The control unit 60 controls driving of the air blowing units 30 and the UV light emission units 40 of the seasoning units 100, in accordance with operating information entered through the touch panel 16. The control unit 60 can control the air blowing unit 30 and the UV light emission unit 40 individually in each seasoning unit 100. Moreover, the control unit 60 can individually control the driving of each fan 32 of the air blowing unit 30 and each UV light source 42 of the UV light emission unit 40, and can suitably adjust the air flow volume of each fan 32 and the emission light quantity of each UV light source 42.

The action of the seasoning apparatus 10 in the present embodiment which has the composition described above is as follows.

Firstly, the operator opens the front cover 12 of the seasoning apparatus 10 and pulls out the table 20 of one of the seasoning units 100, from the casing 14. Thereby, the top of the table 20 is exposed.

Next, the operator loads a paper stack S on the table 20. The paper stack S is constituted of sheets of paper on which printing has been carried out by an inkjet printer using the UV-curable aqueous ink, and an image, or the like, has been formed from the UV-curable aqueous ink on at least one face of each of the paper sheets.

In this action, the operator loads the paper stack S in such a manner that the rear side of the paper stack S abuts against the paper pressing plates 50B arranged at the rear end portion of the table 20.

Next, the operator adjusts the positions of the side plates 50F, 50L and 50R so as to be respectively disposed at positions distanced by approximately 3 mm from the sides of the paper stack S.

With the foregoing, the setting of the paper stack S is completed. The operator then pushes the table 20 back so as to be accommodated in the casing 14.

When the table 20 has been accommodated in the casing 14, the paper stack S loaded on the table 20 is surrounded on the four perimeter sides thereof by the side plates 50F, 50L and 50R and the rear side section of the casing 14, and the top of the paper stack S is covered with the ceiling section of the casing 14 or the bottom face of another table 20 in the next seasoning unit 100 positioned thereabove. Thus, the paper stack S is in a substantially sealed state.

As the need arises, the operator can similarly load another paper stack S on the table 20 of another seasoning unit 100.

When all of the paper stacks S have been loaded, the operator closes the front cover 12 and uses the touch panel 16 to instruct the seasoning apparatus 10 to start a seasoning process.

The control unit 60 drives the fans 32 of the air blowing units 30 according to the instruction. Thereby, the ambient air flow is blown from the fans 32 at a prescribed air flow volume. Furthermore, the control unit 60 drives the UV light sources 42 of the UV light emission units 40. Consequently, UV light is emitted from the UV light sources 42 at a prescribed light quantity.

The ambient air flow blown into the casing 14 from the fans 32 passes through the gaps between the stacked paper sheets and flows out through the ventilation apertures formed in the front side plate 50F. Seasoning is promoted due to this ambient air flow being blown through the gaps between the paper sheets.

The UV light emitted from the UV light sources 42 enters the gaps between the paper sheets created by the flow of ambient air from the fans 32, and is incident on the faces of the paper sheets through the gaps. The incident UV light promotes curing of the UV-curable aqueous ink that has been deposited on the faces of the paper sheets.

The blowing of air from the fans 32 is continued for a prescribed duration. This air blowing duration (seasoning duration) is set in accordance with the type of paper, the number of sheets, the printing conditions, and the like, and is set to a sufficient duration required for seasoning all of the paper sheets.

Moreover, the emission of UV light from the UV light sources 42 is also continued for a prescribed duration. This UV light emission duration (UV light irradiation duration or curing duration) is set in accordance with the type of UV-curable aqueous ink, the type of paper, the number of sheets, the printing conditions, and the like, and is set to a sufficient duration required for curing all of the ink. Since the gaps between the paper sheets created by the flow of ambient air blown from the fans 32 enables the UV light emitted from the UV light sources 42 to be incident on the faces of the paper sheets through the gaps, then it is necessary to drive the fans 32 continuously in the curing duration. Consequently, the curing duration is set to be not longer than the seasoning duration.

When the prescribed time (curing duration) has elapsed from the start of UV light emission, the control unit 60 halts the driving of the UV light sources 42. Thereby, the emission of UV light is stopped.

When the prescribed time (seasoning duration) has elapsed from the start of air blowing, the control unit 60 halts the driving of the fans 32. Thereby, the blowing of ambient air is stopped, and the seasoning of the paper stack S is completed.

After completion of the seasoning process, the operator pulls out the table 20 from the casing 14 and recovers the paper stack S that has been completely seasoned. If the seasoning process is to be carried out consecutively for another paper stack S, then the paper stack S to be seasoned is loaded onto the table 20 and the seasoning process is carried out again.

As described above, in the seasoning apparatus 10 according to the present embodiment, the seasoning of the paper sheets in the paper stack S is performed by blowing the ambient air flow thereto from the air blowing unit 30, and further the curing of the UV-curable aqueous ink deposited on the paper sheets is promoted by irradiating the ink with the UV light emitted from the UV light emission unit 40. It is possible to irradiate the ink with UV light for the curing duration that is at most equal to the seasoning duration (for example, 10 minutes). Since the irradiation during a relatively long time is thereby possible, it is possible to promote curing of the ink with UV light of relatively low intensity. It is then possible to use light sources such as fluorescent lamps, which are inexpensive and have a long lifespan, for the ultraviolet light sources 42, and hence a beneficial effect in terms of costs can be expected.

The air blowing units 30 blow air onto the paper stack S in one direction in the present embodiment; however, it is also possible to blow air in a plurality of directions.

In order to prevent external leaking of UV light emitted by the UV light emission units 40, it is desirable that the periphery of the seasoning apparatus 10 is surrounded with louvers.

UV light is emitted as the active light to irradiate the UV-curable ink in the present embodiment; however, it is necessary to emit any active light or radiation that corresponds to the characteristics of ink to be cured. For instance, it is possible to adopt a composition which emits radiation, electrons, or the like, by which the ink is cured.

Second Embodiment

The direction of air blowing by the fans 32 and the direction of UV light emission of the UV light sources 42 are parallel to each other in the first embodiment; however, the direction of UV light emission is not limited to being the same or parallel with the air blowing direction.

Figure 5A:
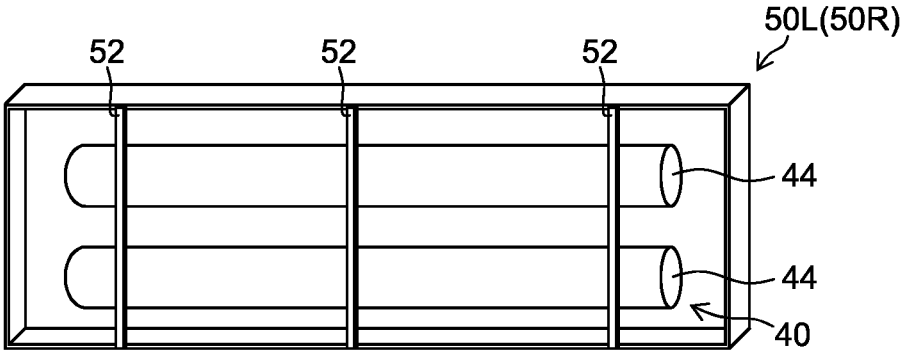
FIGS. 5A to 5C are perspective diagrams showing side plates.

FIG. 5A is a perspective diagram showing the left-hand side plate 50L according to the second embodiment of the present invention. The side plate 50L is a box-shaped member having a hollow interior, and the side that faces the paper stack S is open. UV light sources 44 constituting the UV light emission unit 40 are arranged in the hollow interior of the side plate 50L. The UV light sources 44 are configured to be able to horizontally emit UV light through the open side of the side plate 50L. Guide members 52 which restrict the paper stack S are arranged on the open side of the side plate 50L in order to prevent the paper stack S from being in contact with the UV light sources 44.

The right-hand side plate 50R in the second embodiment is composed similarly to the left-hand side plate 50L. The side plates 50L and 50R are arranged on the table 20 with their open sides facing to each other.

By forming the UV light emission units 40 in the side plates 50L and 50R in this way, it is possible to carry out emission of UV light without making the apparatus large in size. Moreover, it is also possible to irradiate the paper stack S with UV light in the directions substantially perpendicular to the air blowing direction, and therefore the air blowing and the UV light emission can be performed without interference between the air blowing units 30 and the UV light emission units 40. Furthermore, by emitting UV light from both sides of the paper stack S, it is possible to uniformly irradiate the whole face of each sheet of paper with UV light.

It is also possible to arrange the UV light sources 42 on the rear side of the casing 14 similarly to the first embodiment, in addition to the UV light sources 44 on the side plates 50L and 50R, and to emit UV light simultaneously from the UV light sources 42 and 44.

Figure 5B:
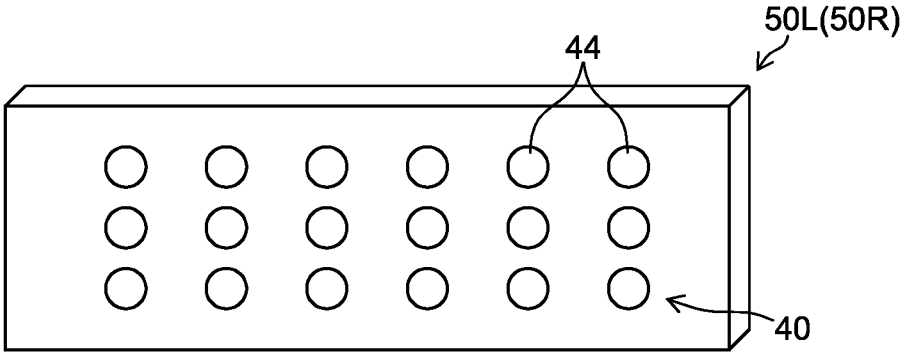

FIG. 5B is a perspective diagram showing the left-hand side plate 50L in a modification of the second embodiment. The left-hand side plate 50L in FIG. 5B is a substantially parallelepiped-shaped box member in which a plurality of UV light emission apertures are formed at prescribed intervals in the side to be adjacent to the paper stack S. The UV light sources 44 are arranged respectively in these UV light emission apertures. The right-hand side plate 50R has a similar composition. When using the side plates 50L and 50R of this kind also, it is possible to irradiate the paper stack S with UV light, and the curing of the UV-curable aqueous ink can be promoted.

Figure 5C:
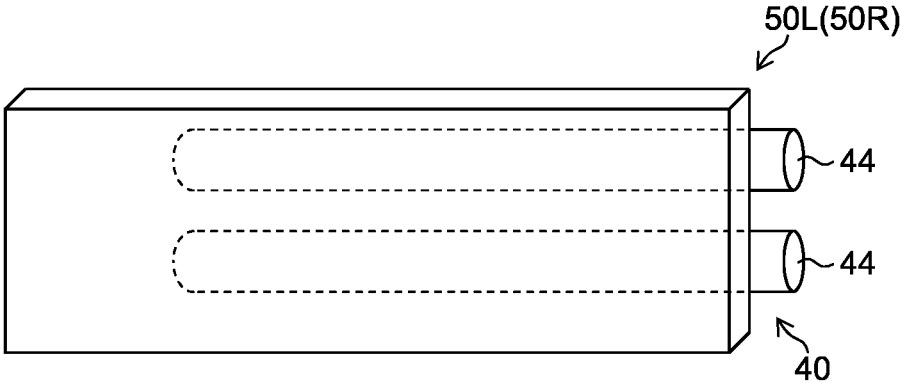

FIG. 5C is a perspective diagram showing the left-hand side plate 50L in another modification of the second embodiment. In the present modification, the side plates 50L and 50R are made from a material that transmits UV light, and the UV light sources 44 are arranged on the opposite sides of the side plates 50L and 50R from the paper stack S. By adopting a composition of this kind, it is possible to emit UV light in the direction perpendicular to the air blowing direction, without arranging the UV light sources in the side plates 50L and 50R.

The UV light sources 42 and 44 of the UV light emission unit 40 described thus far are fixed; however, it is also possible to arrange the UV light sources to be movable or swingable upward and downward. By irradiating the paper stack S with UV light while moving or swinging the UV light sources, it is possible to uniformly irradiate each sheet of paper with UV light.

As described above, the arrangement of the air blowing unit 30 and the UV light emission unit 40 can be determined appropriately.

Third Embodiment

Figure 6:
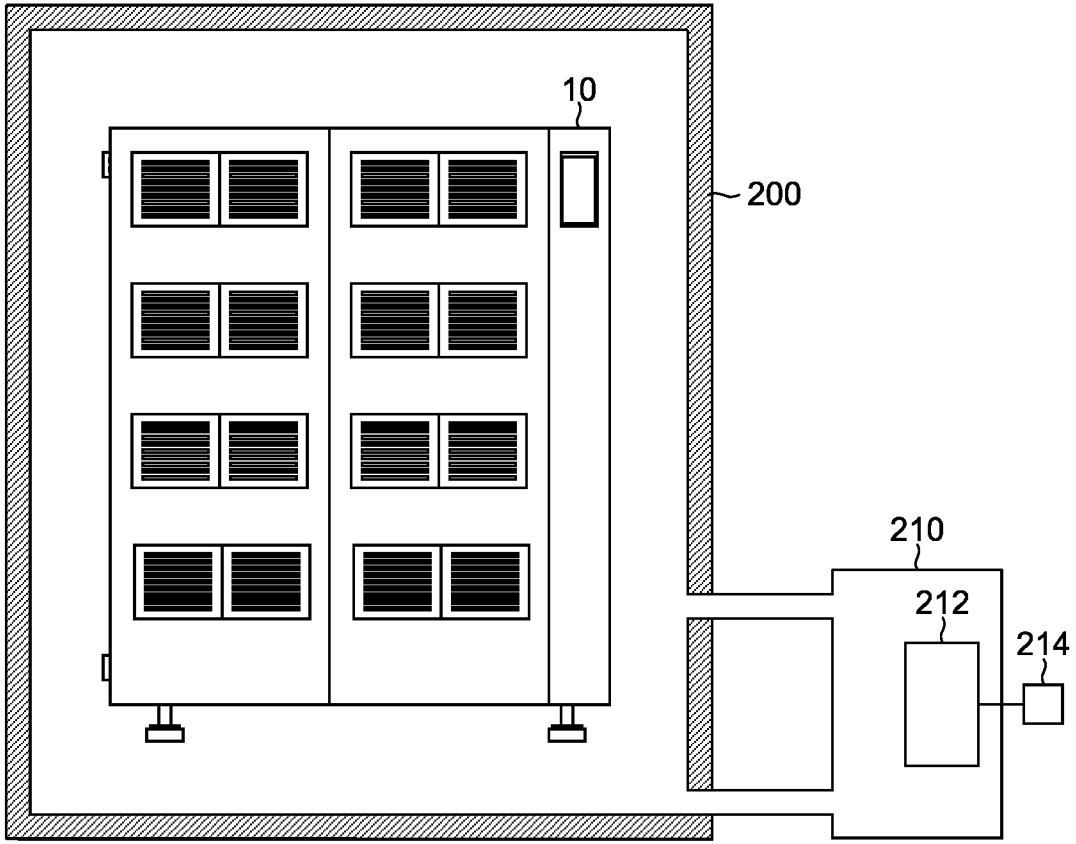
FIG. 6 is a diagram for describing control of the environment of the seasoning apparatus.

FIG. 6 shows the seasoning apparatus 10 according to the third embodiment, which is disposed in a space that is sealed by a surrounding wall 200 (corresponding to a housing). A nitrogen gas circulation device 210 is connected to the sealed space and nitrogen gas is circulated inside the sealed space. The nitrogen gas circulation device 210 includes a temperature and humidity adjustment device 212, and is configured to adjust the temperature and humidity of the circulated nitrogen gas.

The temperature and humidity adjustment device 212 has a temperature and humidity sensor 214. The temperature and humidity sensor 214 measures the temperature and humidity of the environment outside the surrounding wall 200 (external environment) and outputs measurement results to the temperature and humidity adjustment device 212.

The temperature and humidity adjustment device 212 adjusts the temperature and humidity of the nitrogen gas that is circulated by the nitrogen gas circulation device 210, correspondingly to the temperature and humidity of the external environment, on the basis of the measurement results of the temperature and humidity sensor 214. In this case, it is not necessary to have the temperature and humidity of the circulated nitrogen gas to be strictly equal to the temperature and humidity of the external environment, and the temperature and humidity of the circulated nitrogen gas can be adjusted to a range that does not impede the seasoning process. For example, a temperature error of approximately 2° C. with respect to the temperature of the external environment, and a humidity error of approximately 10% with respect to the humidity of the external environment, are permitted in the circulated nitrogen gas.

By sealing the environment of the seasoning apparatus 10 and circulating nitrogen gas in this way, it is possible to remove oxygen, which can impede the polymerization reaction of a radical polymerizable ink, from the atmosphere around the seasoning apparatus 10. Therefore, when using the radical polymerizable UV-curable aqueous ink, it is possible to further promote curing of the ink.

Moreover, it is also possible to appropriately perform seasoning, by adjusting the temperature and humidity of the circulated nitrogen gas, to the temperature and humidity of the external environment.

Here, nitrogen is used as the circulated gas; however, it is also possible to use another inert gas, provided that oxygen in the atmosphere around the seasoning apparatus 10 can be removed. For example, the circulated gas can be carbon dioxide instead of nitrogen.

Furthermore, it is also possible to further promote curing of UV-curable aqueous ink by making the temperature of the atmosphere around the seasoning apparatus 10 higher than the temperature of the external environment. For instance, the temperature and humidity of the nitrogen gas circulated by the nitrogen gas circulation device 210 are adjusted by the temperature and humidity adjustment device 212 respectively to a prescribed temperature that is higher than the temperature of the external environment, and to the humidity of the external environment, on the basis of the measurement results of the temperature and humidity sensor 214. In this state, curing of the UV-curable aqueous ink is promoted by air blowing by the air blowing unit 30 and UV light irradiation by the UV light emission unit 40. Subsequently, the temperature and humidity of the circulated nitrogen gas are adjusted to the temperature and humidity of the external environment on the basis of the measurement results of the temperature and humidity sensor 214. In this state, seasoning can be performed appropriately by air blowing by the air blowing unit 30 and UV light irradiation by the UV light emission unit 40. When curing of the ink is completed at the high temperature, the UV light emission unit 40 is halted and seasoning is performed at the temperature and humidity of the external environment by driving the air blowing unit 30 only.

Here, the prescribed temperature of the circulated nitrogen gas to be heated is not lower than 50° C., in order to promote curing of the UV-curable aqueous ink, but adverse effects to the paper sheets can be envisaged if the temperature exceeds 100° C. Therefore, it is desirable that the prescribed temperature described above is lower than 100° C. and not lower than 50° C.

Similarly, the humidity of the atmosphere around the seasoning apparatus 10 can be set to a humidity that is suitable for curing of the UV-curable aqueous ink. For example, the humidity of the nitrogen gas that is circulated by the nitrogen gas circulation device 210 is adjusted by the temperature and humidity adjustment device 212 to a humidity that is suited to curing of the UV-curable aqueous ink. The temperature of the circulated nitrogen gas can be set to the temperature of the external environment or to a high temperature of 50° C. to 100° C., as described above. In this state, curing of the UV-curable aqueous ink is promoted by air blowing by the air blowing unit 30 and UV light irradiation by the UV light emission unit 40. Subsequently, the temperature and humidity of the circulated nitrogen gas are adjusted to the same temperature and humidity as the external environment on the basis of the measurement results of the temperature and humidity sensor 214. In this state, seasoning can be performed appropriately by air blowing by the air blowing unit 30 and UV light irradiation by the UV light emission unit 40. In this case also, when curing of the ink has been completed, it is possible to halt the UV light emission unit 40 and drive the air blowing unit 30 only.

It is possible to configure the nitrogen gas circulation device 210, the temperature and humidity adjustment device 212 and the temperature and humidity sensor 214 so as to be controllable from the control unit 60 of the seasoning apparatus 10.

Active Light Curable Aqueous Ink

The active light curable aqueous ink (e.g., UV-curable aqueous ink) described in the present specification is an ink that contains water as a solvent, and also contains an active light curable resin and a coloring material. The specific composition of the active light curable aqueous ink or UV-curable aqueous ink is described below.

The ink composition contains a pigment, and can be composed by also using a dispersant, a surfactant, and other components, according to requirements. In order to improve the durability of the image formed from the ink, it is also possible to make the ink less liable to wet and spread on the face of paper sheet by raising the viscosity or surface tension of the ink. For example, of the components listed below, it is desirable to increase the dispersed particle components, such as pigment or resin particles, since this not only increases the viscosity of the ink, but also accelerates aggregation and can be expected to enhance the strength of the aggregate body as such.

The ink composition contains at least one type of pigment as a coloring material component. There are no particular restrictions on the pigment, and it is possible to select a pigment appropriately according to the object, for example, the pigment can be an organic or inorganic pigment. It is desirable from the viewpoint of ink coloring properties that the pigment should be one which is virtually insoluble or has poor solubility in water.

The ink composition can include at least one type of dispersant. As the pigment dispersant, it is possible to use either a polymer dispersant or a low-molecular-weight surfactant. The polymer dispersant can be a water-soluble dispersant or a water-insoluble dispersant.

From the viewpoint of the lightfastness and the quality of the image formed from the ink, and the like, it is desirable that the ink composition includes a pigment and a dispersant, more desirably, an organic pigment and a polymer dispersant, and especially desirably, an organic pigment and a polymer dispersant having a carboxyl group. Moreover, from the viewpoint of aggregating properties, desirably, the pigment is coated with a polymer dispersant having a carboxyl group and is water-insoluble. Furthermore, from the viewpoint of aggregating properties, desirably, the acid value of the self-dispersing polymer particles which are described hereinafter is smaller than the acid value of the polymer dispersant.

The average particle size of the pigment is desirably 10 nm to 200 nm, but is not limited to this. Furthermore, there are no particular restrictions on the particle size distribution of the coloring material, and it is possible to have a broad particle size distribution or a mono-disperse particle size distribution. Furthermore, it is also possible to combine the use of two or more types of coloring material each having mono-disperse particle size distribution.

The pigments can be used independently, or two or more types of pigment can be used in combination.

The content of the pigment in the ink composition is desirably 1 wt % to 25 wt %, from the viewpoint of the density of the image formed from the ink, but is not limited in particular.

The ink composition can contain at least one type of polymer particles. The polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image.

In order to react with the aggregating agent, polymer particles having an anionic surface charge can be used, a commonly known latex can be used provided that adequate reactivity and ejection stability can be obtained, and it is especially desirable to use self-dispersing polymer particles.

Desirably, the ink composition contains at least one type of self-dispersing polymer particles as the polymer particles. The self-dispersing polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image. Furthermore, the self-dispersing polymer particles are resin particles which are desirable from the viewpoint of the ejection stability and the stability of the liquid composition containing the pigment (and in particular, dispersion stability).

The term of self-dispersing polymer particles means particles of a water-insoluble polymer which does not contain free emulsifier and which can be obtained as a dispersion in an aqueous medium due to a functional group (particularly, an acid group or salt thereof) contained in the polymer itself, without the presence of a separate surfactant.

The acid value of the self-dispersing polymer is desirably not more than 50 KOH mg/g, from the viewpoint of achieving good aggregating properties upon making contact with the treatment liquid, but is not limited in particular.

The self-dispersing polymer particles desirably contain a polymer having a carboxyl group, from the viewpoint of self-dispersing properties and the aggregating speed upon contact with the treatment liquid, but are not limited in particular.

The molecular weight of the water-insoluble polymer which composes the self-dispersing polymer particles is desirably 3000 to 200,000 in terms of the weight-average molecular weight, but is not limited in particular.

The average particle size of the self-dispersing polymer particles is desirably in the range of 10 nm to 400 nm in terms of the volume-average particle size, but is not limited in particular. If the volume-average particle size is not smaller than 10 nm, manufacturability is improved and if the volume-average particle size is not larger than 1 μm, then storage stability is improved.

The self-dispersing polymer particles used can be of one type only or a combination of two or more types. The content of the self-dispersing polymer particles in the ink composition is desirably 1 wt % to 30 wt % with respect to the ink composition, from the viewpoint of the aggregation speed and the image luster, and so on, but is not limited in particular.

Furthermore, the content ratio between the pigment and the self-dispersing polymer particles in the ink composition (for example, the ratio of water-insoluble pigment particles/self-dispersing polymer particles) is desirably 1/0.5 to 1/10, from the viewpoint of the wear resistance of the image formed from the ink, and the like, but is not limited in particular.

The ink composition contains at least one type of water-soluble polymerizable compound which is polymerized by an active energy ray.

The term of water-soluble means that the compound can be dissolved to a prescribed density or above in water, and the compound should be dissolvable in an aqueous ink (and desirably in a uniform fashion). Furthermore, the compound can also be dissolved in the ink (desirably in a uniform fashion), by raising the solubility through the addition of a water-soluble organic solvent, which is described hereinafter. More specifically, the solubility of the compound with respect to water is desirably not less than 10 wt % and more desirably, not less than 15 wt %.

From the viewpoint of not impeding reaction between the aggregating agent, the pigment and the polymer particles, the polymerizable compound is desirably an nonionic or cationic polymerizable compound and preferably is a polymerizable compound having a solubility of not less than 10 wt % (and more desirably, not less than 15 wt %) with respect to water.

From the viewpoint of raising resistance to wear, the polymerizable compound is desirably a polyfunctional monomer, preferably a bifunctional to a hexafunctional monomer, and from the viewpoint of achieving both solubility and wear resistance, a bifunctional to a tetrafunctional monomer.

The ink composition can contain only one type or a combination of two or more types of polymerizable compound.

The content of the polymerizable compound in the ink composition is desirably 30 wt % to 300 wt % and more desirably 50 wt % to 200 wt %, with respect to the total solid content of the pigment plus the self-dispersing polymer particles. If the content of the polymerizable compound is not less than 30 wt %, then the image strength is improved and excellent wear resistance of the image is obtained, whereas if the content is not more than 300 wt %, then an advantage is obtained in terms of pile height.

The ink composition can also contain at least one type of initiator which initiates polymerization of the polymerizable compound by an active energy ray, either in addition to the treatment liquid described below or in the absence of the treatment liquid. A photopolymerization initiator can be used, either one type only or a combination or two or more types, and can be used conjointly with a sensitizing agent.

The initiator can include a suitably selected compound which is capable of starting a polymerization reaction by application of an active energy ray; for example, it is possible to use an initiator (for example, a photopolymerization initiator) which creates an active species (radical, acid, base, or the like) upon application of radiation, light, electrons, or the like.

If the ink composition contains an initiator, then the content of the initiator with respect to the ink composition is desirably 1 wt % to 40 wt % with respect to the polymerizable compound, but is not limited in particular. If the content of the initiator is not less than 1 wt %, then the wear resistance of the image is further improved, which is advantageous in the case of high-speed recording, and if the content of the initiator is not more than 40 wt %, then an advantage in terms of ejection stability is obtained.

The ink composition can contain at least one type of water-soluble organic solvent. A water-soluble organic solvent can obtain beneficial effects in preventing drying, providing lubrication or promoting permeation. In order to prevent drying, the solvent is used as an anti-drying agent which prevents blockages caused by ink adhering to the ink ejection ports of the ejection nozzles and drying to form aggregate material, and in order to prevent drying and achieve lubrication, a water-soluble organic solvent having a lower vapor pressure than water is desirable. Furthermore, in order to promote permeation, the solvent can be used as a permeation promoter which raises the permeability of the ink into the paper.

A water-soluble organic solvent having a lower vapor pressure than water is desirable as an anti-drying agent.

It is possible to use only one type or a combination of two or more types of anti-drying agent. The content of the anti-drying agent is desirably in the range of 10 wt % to 50 wt % in the ink composition, but is not limited in particular.

A water-soluble organic solvent is suitable as a permeation promoter with the object of causing the ink composition to permeate more readily into the recording medium (printing paper, or the like). It is possible to use only one type or a combination of two or more types of permeation promoter. The content of the permeation promoter is desirably in the range of 5 wt % to 30 wt % in the ink composition, but is not limited in particular. Furthermore, the permeation promoter is desirably used in a weight range that does not cause image bleeding or print through.

The ink composition contains water, but there are no particular restrictions on the amount of water. However, a desirable content of water is 10 wt % to 99 wt %, more desirably, 30 wt % to 80 wt %, and even more desirably, 50 wt % to 70 wt %.

The ink composition can be composed by using other additives apart from the components described above. The other additives can be commonly known additives, for example, an anti-drying agent (humidifying agent), an anti-fading agent, an emulsion stabilizer, a permeation promoter, an ultraviolet light absorber, an antibacterial agent, an antiseptic agent, a pH adjuster, a surface tension adjuster, an antifoaming agent, a viscosity adjuster, a dispersant, a dispersion stabilizer, an anti-rusting agent, a chelating agent, or the like.

The treatment liquid contains at least an aggregating agent which aggregates the components in the ink composition described above, and can also be composed by using other components according to requirements. By using a treatment liquid in addition to the ink composition, it is possible to raise the speed of inkjet recording, and an image having excellent definition (reproducibility of fine lines and intricate detail portions) with good density and high resolution is obtained. Furthermore, by improving the preparation of the treatment liquid and the ink composition, it is possible to raise the strength of the actual image formed, and hence the durability of the image with respect to high-pressure air blowing, and the like, can be enhanced.

The aggregating agent used can be a compound capable of changing the pH of the ink composition, or a multivalent metal salt, or a polyallyl amine. It is desirable to choose an aggregating agent that is capable of rapidly separating the solid component from the carrying component (the liquid component) after aggregation, or making the aggregate material itself more rigid.

The aggregating agent used can be of one type only or a combination of two or more types.

The content of the aggregating agent which aggregates the ink composition in the treatment liquid is desirably 1 wt % to 50 wt %, but is not limited in particular.

The treatment liquid can also contain other additives, in addition to these components. The other additives can be commonly known additives, for example, an anti-drying agent (humidifying agent), an anti-fading agent, an emulsion stabilizer, a permeation promoter, an ultraviolet light absorber, an antibacterial agent, an antiseptic agent, a pH adjuster, a surface tension adjuster, an antifoaming agent, a viscosity adjuster, a dispersant, a dispersion stabilizer, an anti-rusting agent, a chelating agent, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A seasoning apparatus, comprising:

a casing;

a table on which a stack of paper sheets is loaded, each of the paper sheets having at least one face on which an active light curable aqueous ink has been deposited;

a front side plate, a right-hand side plate and a left-hand side plate which are arranged on the table, the right-hand side plate and the left-hand side plate being arranged to oppose to each other and to be perpendicular to the front side plate, wherein in a state where the table is accommodated in the casing, the front side plate faces to an inner wall of a rear side section of the casing, and the stack loaded on the table is surrounded on four perimeter sides thereof by the front side plate, the right-hand side plate, the left-hand side plate and the inner wall of the rear side section of the casing;

an air blowing device which is arranged at the rear side section of the casing, the air blowing device including one or more outflow ports being configured to blow air in an air blowing direction to a first side of the stack loaded on the table;

an active light emitter which is arranged on at least one of the rear side section of the casing, the right-hand side plate and the left-hand side plate, and the active light emitter being configured to emit an active light in an active light emitting direction to at least one of the first side, a second side and a third side of the stack loaded on the table; and a control device including circuitry that is configured to perform control on the air blowing device and on the active light emitter:

to cause the air blowing device to blow the air to the stack to create gaps between faces of the paper sheets, and to cause the active light emitter to emit the active light to the stack to cause the active light to enter the gaps, wherein the active light emitter includes active light emitter elements configured to emit the active light to at least two of the first, second and third sides of the stack loaded on the table, at least one of the right-hand side plate and the left-hand side plate is advanceable and retractable relative to each other, and the active light emitter elements are arranged respectively on the right-hand side plate and the left-hand side plate.

2. The seasoning apparatus as defined in claim 1, wherein the air blowing direction and the active light emitting direction are substantially perpendicular to each other.

3. A seasoning apparatus comprising:

a casing;

a table on which a stack of paper sheets is loaded, each of the paper sheets having at least one face on which an active light curable aqueous ink has been deposited;

a front side plate, a right-hand side plate and a left-hand side plate which are arranged on the table, the right-hand side plate and the left-hand side plate being arranged to oppose to each other and to be perpendicular to the front side plate, wherein in a state where the table is accommodated in the casing, the front side plate faces to an inner wall of a rear side section of the casing, and the stack loaded on the table is surrounded on four perimeter sides thereof by the front side plate, the right-hand side plate, the left-hand side plate and the inner wall of the rear side section of the casing;

an air blowing device which is arranged at the rear side section of the casing, the air blowing device including one or more outflow ports being configured to blow air in an air blowing direction to a first side of the stack loaded on the table;

an active light emitter which is arranged on at least one of the rear side section of the casing, the right-hand side plate and the left-hand side plate, and the active light emitter being configured to emit an active light in an active light emitting direction to at least one of the first side, a second side and a third side of the stack loaded on the table; and a control device including circuitry that is configured to perform control on the air blowing device and on the active light emitter:

to cause the air blowing device to blow the air to the stack to create gaps between faces of the paper sheets, and to cause the active light emitter to emit the active light to the stack to cause the active light to enter the gaps, wherein:

the active light emitter includes active light emitter elements configured to emit the active light to at least two of the first, second and third sides of the stack loaded on the table, the right-hand side plate and the left-hand side plate are made from a material transmitting the active light, at least one of the right-hand side plate and the left-hand side plate is advanceable and retractable relative to each other, and the active light emitter elements are arranged on sides of the right-hand side plate and the left-hand side plate to face the stack loaded on the table across the right-hand side plate and the left-hand side plate, respectively.

4. The seasoning apparatus as defined in claim 1, wherein the active light emitter is movable up and down.

5. The seasoning apparatus as defined in claim 1, further comprising:

a housing which shuts off the stack loaded on the table from an external environment; and an inert gas supply device that comprises at least one of a container and a conduit, the inert gas supply device being configured to supply inert gas inside the housing.

6. The seasoning apparatus as defined in claim 5, wherein temperature and humidity are adjusted inside the housing by a temperature and humidity adjustment device included in said seasoning apparatus, wherein said temperature and humidity adjustment device includes a first sensor, and is configured to adjust a first temperature and a first humidity inside the housing.

7. The seasoning apparatus as defined in claim 6, further comprising:

a humidity measurement device which includes a second sensor and is configured to measure a second humidity outside the housing, wherein the temperature and humidity adjustment device is configured to adjust the first temperature inside the housing to be lower than 100° C. and not lower than 50° C., and to adjust the first humidity inside the housing correspondingly to the second humidity outside the housing.

8. The seasoning apparatus as defined in claim 6, further comprising:

a temperature and humidity measurement device which includes a second sensor and is configured to measure a second temperature and a second humidity outside the housing, wherein the temperature and humidity adjustment device is configured to adjust the first temperature inside the housing to be lower than 100° C. and not lower than 50° C., and then, after a prescribed period of time has elapsed, to adjust the first temperature and the first humidity inside the housing correspondingly to the second temperature and the second humidity outside the housing.

9. The seasoning apparatus as defined in claim 5, wherein the inert gas is one of nitrogen and carbon dioxide.

10. The seasoning apparatus as defined in claim 1, wherein the active light emitter is configured to emit ultraviolet light by which the active light curable aqueous ink is cured.

11. The seasoning apparatus as defined in claim 1, wherein:

a height from the table to the air blowing device and a height from the table to the active light emitter are substantially equal to each other; and the air blowing direction and the active light emitting direction are substantially parallel to the faces of the paper sheets.

12. The seasoning apparatus as defined in claim 1, wherein:

the control device is configured to cause the air blowing device to continue blowing the air to the stack for an air blowing duration; and the control device is configured to cause the active light emitter to emit the active light to the stack for only a light irradiation duration, the light irradiation duration being included in the air blowing duration and not longer than the air blowing duration.

* * * * *